US005084939A

United States Patent [19]

Garman

[11] Patent Number: 5,084,939

[45] Date of Patent: Feb. 4, 1992

[54] DOOR DAMPENING ASSEMBLY

[75] Inventor: Ronald H. Garman, Pekin, Ill.

[73] Assignee: Caterpillar Inc., Peoria, Ill.

[21] Appl. No.: 612,368

[22] Filed: Nov. 14, 1990

[51] Int. Cl.[5] ..... E05F 3/02

[52] U.S. Cl. ..... 16/84; 16/82

[58] Field of Search ..... 16/84, 85, 82

[56] References Cited

U.S. PATENT DOCUMENTS

| | | | |
|---|---|---|---|
| 995,665 | 6/1911 | Danielson | 16/84 |
| 1,788,587 | 1/1931 | Perry | 16/84 |
| 2,039,079 | 4/1936 | Hoffman | 16/84 |
| 2,707,798 | 5/1955 | Comey et al. | 16/85 |
| 4,062,577 | 12/1977 | Butterfield et al. | 292/262 |
| 4,141,104 | 2/1979 | Watson | 16/65 |
| 4,401,179 | 8/1983 | Anderson | 180/89.14 |
| 4,596,383 | 6/1986 | Howard | 16/84 |
| 4,609,216 | 9/1986 | Baker et al. | 292/262 |
| 4,670,939 | 6/1987 | Fisher | 16/297 |

FOREIGN PATENT DOCUMENTS

| | | | |
|---|---|---|---|
| 692876 | 6/1940 | Fed. Rep. of Germany | 16/84 |

*Primary Examiner*—Robert L. Spruill
*Assistant Examiner*—D. M. Gurley
*Attorney, Agent, or Firm*—Claude F. White

[57] ABSTRACT

A door dampening assembly for dampening the swinging motion of a vehicle door includes a timing plate, a mounting bracket, and an expandable and contractible link connected to and between the timing plate and the mounting bracket. Operator access doors on construction vehicles can cause damage to the door hinge, the door frame, or the door itself, if left unrestrained during swinging movement of the doors from an open position to a closed position. The subject dampening assembly allows the vehicle door to swing freely from a fully open position to a partially open position. The timing plate and the expandable and retractable link decelerate the door to a partially open positon, thereby preventing any damage to the door or other vehicle components.

3 Claims, 2 Drawing Sheets

DOOR DAMPENING ASSEMBLY

DESCRIPTION

1. Technical Field

This invention relates generally to a door dampening assembly and more particularly to such an assembly which allows a vehicle door to free-swing to a predetermined point and then decelerates the door.

2. Background Art

Large construction and earthmoving vehicles are often equipped with fully enclosed operator's stations to provide comfort and protection for the machine operator. These enclosures include one or more doors for entering and exiting of the operator's station. The doors are generally large and heavy and can generate considerable momentum when swinging from an open position to a closed position, or from a closed position to an open position. If the momentum of the door is unchecked, damage to the door, the door hinge, or the cab structure could occur. Various types of door control devices have been disclosed in the prior art.

One type of assist assembly for a cab structure is disclosed in U.S. Pat. No. 4,401,179, issued Aug. 30, 1983, to R. M. Anderson. In this patent, a plurality of links, levers, bellcranks, and gas spring actuators assist the machine operator in moving a rotatable cab structure between its extreme stop positions.

Another type of door control device is disclosed in U.S. Pat. No. 4,141,104, issued Feb. 27, 1979, to R. O. Watson. In this patent, an overcenter control device resiliently holds a door in a predetermined open position after being moved past dead center in one direction, or holds the door closed after being moved past dead center in the opposite direction. The control device includes a plurality of springs, links and brackets.

Although the devices disclosed in the above-noted patents would appear to function satisfactorily for the applications intended, both devices are rather complex and include a large number of components.

The present invention is directed toward overcoming one or more of the problems as set forth above.

DISCLOSURE OF THE INVENTION

In one aspect of the present invention, a door dampening assembly, for dampening the swinging motion of a vehicle door as the door swings in an arc about a hinge, has a timing plate which is pivotally secured to a frame portion of the vehicle, a mounting bracket which is secured to the vehicle door, and an extendable and retractable link extending between and connected to the timing plate and the mounting bracket.

Enclosed operator's stations, or cabs, on large earthmoving machines include one or more hinged door assemblies for entering and exiting the cab. These door assemblies are often large and heavy and are hinged to the vehicle cab for easy swinging motion during opening and closing of the door. These doors are often left fully open during machine operations to provide ventilation and better visibility for the operator. Many machines provide a hold-open device to hold the doors in the fully open position. However, when the door is released from the hold-open device, it can freely swing toward the closed position with considerable force. If this force is left unchecked, damage can possibly occur to the door, the door hinge or the cab structure.

The subject invention provides an assembly for dampening the swinging force of a vehicle door as the door swings from an open position toward a closed position.

BEST MODE FOR CARRYING OUT THE INVENTION

Figure 1:
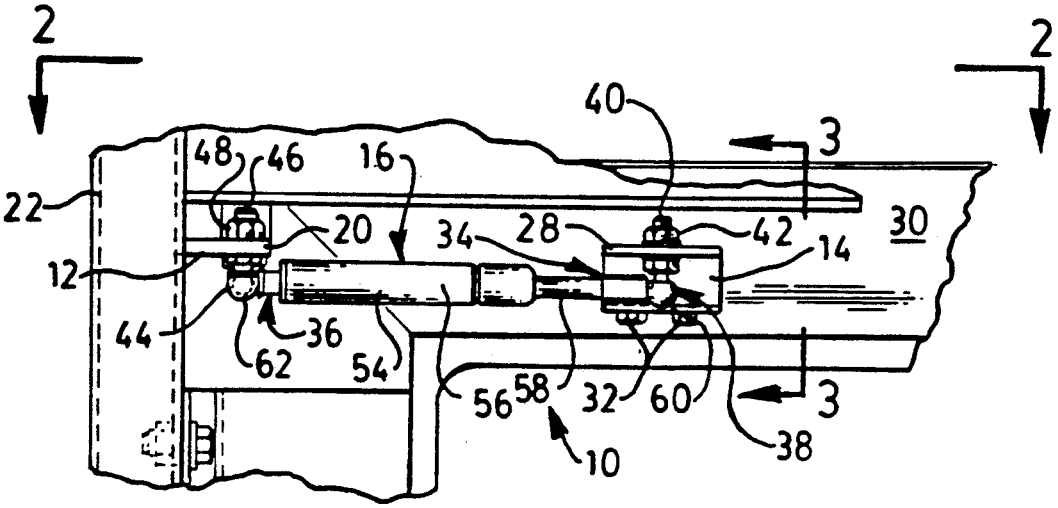
FIG. 1 is a diagrammatic side view of the subject invention including a portion of a vehicle door and a portion of a cab frame.

Referring to the drawings, a door dampening assembly 10 includes a timing plate 12, a bracket 14, and an extendable and retractable link 16. The timing plate 12 has first and second mounting portions 18,20 with the first portion 18 being pivotally secured to a vehicle frame, or cab frame portion 22 by a pivot pin 24. The mounting bracket 14 has first and second legs 26,28 with the first leg 26 being secured to a vehicle door 30 by a plurality of threaded fasteners 32. The link 16 has first and second end portions 34,36 with the first end portion 34 being connected to the second leg 28 of the mounting bracket 14 by a first connector or first ball and socket joint 38. The first joint 38 has a threaded portion 40 which penetrates the second leg 28 and is secured by a threaded nut 42. The second end portion 36 of the link 16 is connected to the second portion 20 of the timing plate 12 by a second connector or second ball and socket joint 44. The second joint 44 has a threaded portion 46 which penetrates the timing plate 12 and is secured by a threaded nut 48.

A door hinge 50 connects the vehicle door 30 to the cab from portion 22 to provide swinging motion of the door 30 with respect to the cab frame portion 22. The door dampening assembly 10 dampens the swinging motion of the vehicle door 30 as the door 30 swings in an arc 52 about the hinge 50 from a closed door position to an open door position or from a fully open door position to a partially open door position.

The extendable and retractable link 16 preferably includes a gas spring cylinder 54. The cylinder 54 has a cylindrical portion 56 and a rod portion 58. The first connector 38 has a ball portion 60 which is adapted to secure the first connector 38 to the rod portion 58 of the gas spring cylinder 54. The second connector 44 has a ball portion 62 which is adapted to secure the second connector 44 to the cylinder portion 56 of the gas spring cylinder 54. The ball portions 60,62 provide pivotal motion of the gas spring cylinder 54 with respect to the timing plate 12 and the bracket 14 as the door 30 swings about the hinge 50.

The timing plate 12 has a flat substantially planar surface or stop portion 64 which is adapted to contact the vehicle frame portion 22 when the vehicle door 30 is in a fully closed and a partially open position. The partially open position of the vehicle door 30 is represented by the phantom line position 66 of the gas spring cylinder 54 and point 68 on the arc 52. The first mounting portion 18 of the timing plate has a first through aperture 74 and the second mounting portion 20 has a second through aperture 76 spaced from the first aperture 74. The surface 64 lays in a first plane 78 which is substantially parallel to a second plane 80 which passes through the center points 82,84 of the first and second apertures 74,76 respectively. The pivot pin 24 is adapted to penetrate the first aperture 74 in the first mounting portion 18 and the timing plate 12 is adapted to pivot about the pivot pin 24 as the vehicle door 30 moves from the partially open door position 66,68 to a fully open door position, represented by the phantom line position 86 of the gas spring cylinder 54 and point 88 on the arc 52. The threaded portion 40,46 of one of the first and second connectors 38,44 is adapted to penetrate the second aperture 76 in the second mounting portion 20, and is secured by the nut 48 for securing one of the first and second connectors 38,44 to the timing plate 12.

INDUSTRIAL APPLICABILITY

With reference to the drawings, the subject door dampening assembly 10 is particularly useful in dampening the swinging motion of a vehicle door 30 as the door 30 swings about a hinge 50 which secures the door 30 to a vehicle frame portion 22.

Figure 2:
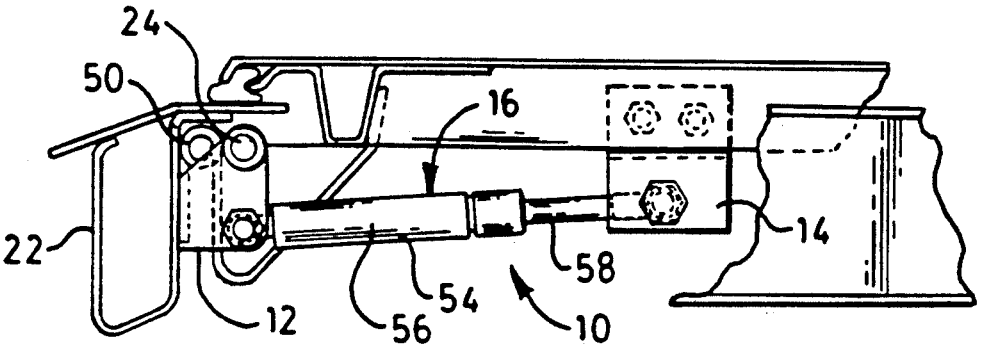
FIG. 2 is a diagrammatic plan view partly in section and taken generally along the lines 2—2 of FIG. 1.
Figure 3:
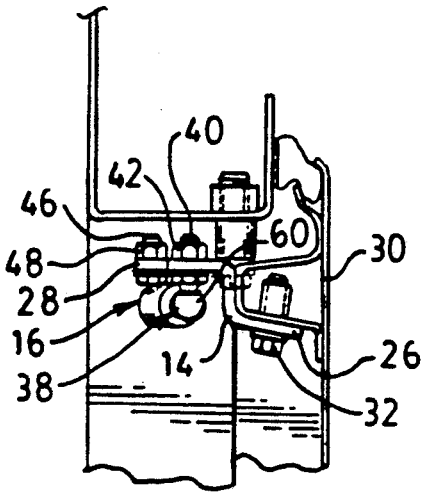
FIG. 3 is a diagrammatic sectional view taken generally along the lines 3—3 of FIG. 1.
Figure 4:
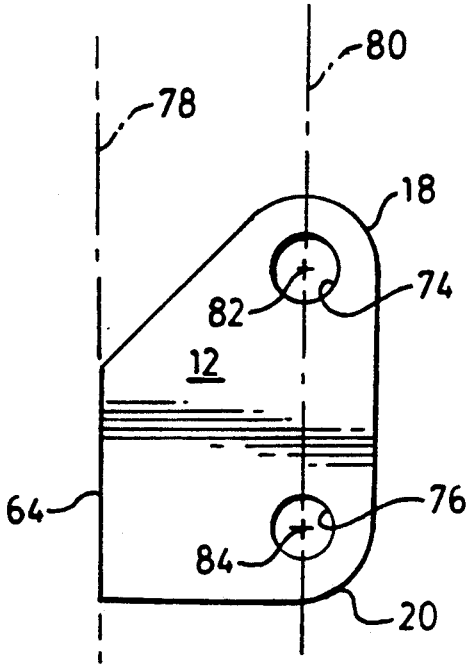
FIG. 4 is a diagrammatic plan view of a timing plate of the present invention.

As shown in FIGS. 1 and 2, the door 30 is fully closed and the flat planar surface 64 of the timing plate 12 is in contact with the vehicle frame, or cab portion, 22. In this position, the gas within the gas spring cylinder 54 is slightly compressed. When the latch on the door 30 is released by the vehicle operator, the compressed gas within the cylinder 54 moves the rod portion 58 outwardly of the cylinder 54 and the cylinder 54 moves from the solid line position shown in FIG. 5 to the phantom line position 66, thereby opening the vehicle door to the partially open position represented by the point 68 on the arc 52. As the door 30 moves from the closed position to the partially open position, the cylinder 54 pivots about the ball and socket joint 44, and the timing plate 12 remains unmoved with the surface 64 in contact with the frame portion 22.

Figure 5:
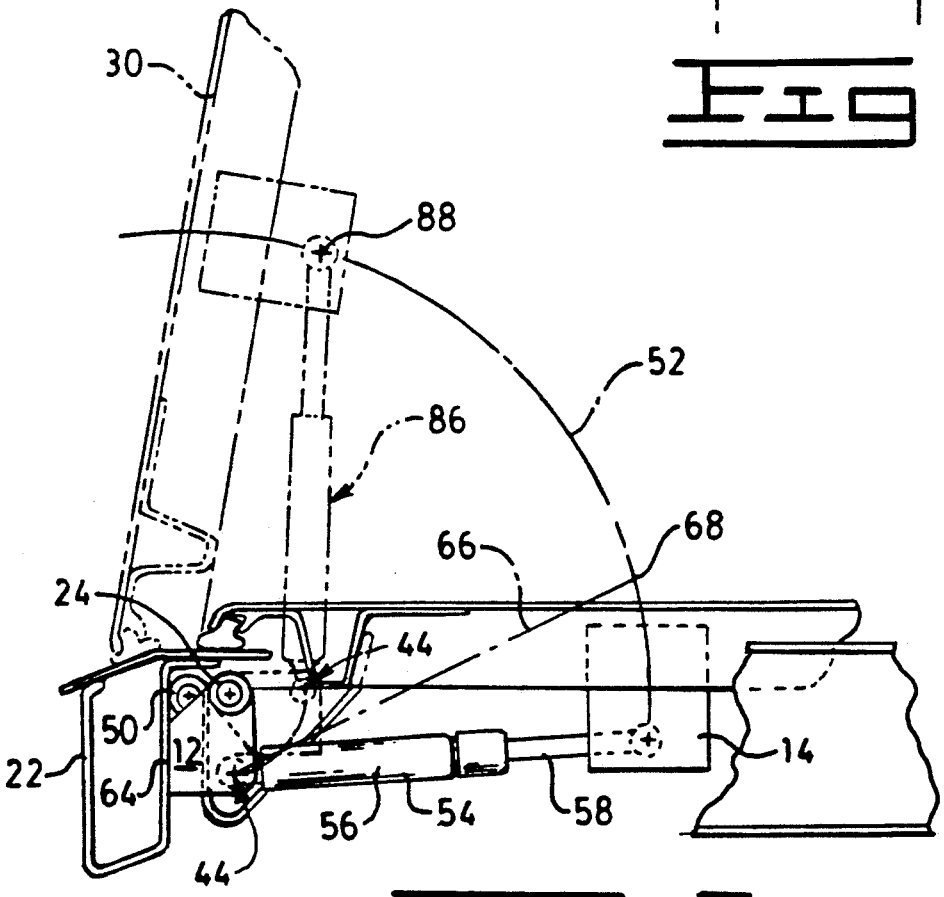
FIG. 5 is a diagrammatic plan view similar to FIG. 2 with the subject door dampening assembly shown in several positions.

As the vehicle operator moves the door 30 from the partially open position to the fully open position, represented by the phantom line position 86 of the cylinder 54 and the point 88 on the arc 52, the timing plate 12 pivots about the pivot pin 24 until the timing plate 12 reaches the phantom line position shown in FIG. 5. At this position of the timing plate 12, the vehicle door is in the fully open position and can be held in this position by a hold open device (not shown). As the cylinder 54 moves from the position 66 to the position 86, the rod portion 58 does not extend out of the cylindrical portion 56 and the distance from the point 68 to the connector 44 is substantially equal to the distance from the point 88 to the connector 44 in the fully open door position. This is made possible by the pivoting of the timing plate 12 about the pivot pin 24.

When the vehicle operator releases the hold open device, the vehicle door 30 swings freely toward the closed door position. The door 30 will swing freely toward the closed position because the door hinge 50 is intentionally set at a slight angle to the frame of the cab. This angle is about 4°, which is enough to cause the door 30 to swing toward the closed position due to the weight of the door 30. As the door 30 swings around the hinge 50, the timing plate 12 pivots about the pivot pin 24 until the stop surface 64 contacts the frame portion 22. The door 30 then decelerates to the partially open position with the cylinder 54 at the approximate position represented by the line 66 and the point 68. During this movement of the door 30 from the fully open position to the partially open position, the rod portion 58 has not moved into the cylindrical portion 56. The vehicle operator can now grasp the door 30 and pull it to the closed door position where it will be latched. As the door 30 is pulled closed, the rod portion 58 moves into the cylindrical portion 56 and slightly compresses the gas within the cylinder 54.

It is evident that the subject invention dampens the swinging motion of a vehicle door 30 as the door swings from a fully open position to a partially open position, thereby preventing possible damage to the door 30, the door hinge 50, or the frame structure 22.

Other aspects, objects and advantages of this invention can be obtained from a study of the drawings, the disclosure, and the appended claims.

I claim:

1. A door dampening assembly for dampening the motion of a vehicle door as the door moves in an arc about a fixed hinge portion, from a fully open position, to a partially open position, and to a fully closed position, said fixed hinge portion being secured to a vehicle frame portion, said door dampening assembly comprising:

a gas spring cylinder having a cylindrical portion and a rod portion, said cylindrical portion and said rod portion having a combined length "l" in said partially open position and a combined length "L" in said fully open position, said length "l" being substantially equal to said length "L";

a first connector having a threaded portion and a ball portion, said threaded portion being adapted to secure said first connector to one of said vehicle frame portion and said vehicle door, said ball portion being adapted to pivotally secure said first connector to said gas spring cylinder cylindrical portion;

a second connector having a threaded portion and a ball portion, said threaded portion being adapted to secure said second connector to the other one of said vehicle frame portion and said vehicle door, said ball portion being adapted to pivotally secure said second connector to said gas spring cylinder rod portion; and a timing plate having first and second mounting portions and a stop portion, said first mounting portion being adapted to pivotally secure said timing plate to said vehicle frame portion and said second mounting portion being adapted to secure the threaded portion of one of said first and second connectors to said timing plate, said stop portion having a flat substantially planar surface, said surface being adapted to contact said vehicle frame portion.

2. A door dampening assembly, as set forth in claim 1, wherein said first and second mounting portions of said timing plate define first and second spaced apart through apertures, said planar surface lying in a first plane which is substantially parallel to a second plane which passes through the center points of said first and second apertures.

3. A door dampening assembly, as set forth in claim 1 including a pivot pin and, wherein said timing plate is adapted to pivot about said pivot pin as said door moves from said partially open door position to said fully open door position.

* * * * *